US008243952B2

(12) United States Patent
Thormundsson et al.

(10) Patent No.: US 8,243,952 B2
(45) Date of Patent: Aug. 14, 2012

(54) MICROPHONE ARRAY CALIBRATION METHOD AND APPARATUS

(75) Inventors: Trausti Thormundsson, Irvine, CA (US); Harry K. Lau, Norwalk, CA (US); Yair Kerner, Kiryat Ono (IL)

(73) Assignee: Conexant Systems, Inc., Newport Beach, CA (US)

( * ) Notice: Subject to any disclaimer, the term of this patent is extended or adjusted under 35 U.S.C. 154(b) by 765 days.

(21) Appl. No.: 12/341,777

(22) Filed: Dec. 22, 2008

(65) Prior Publication Data

US 2010/0158267 A1 Jun. 24, 2010

(51) Int. Cl.
*H04R 3/00* (2006.01)

(52) U.S. Cl. ..... 381/92; 381/94.4; 381/101; 381/103

(58) Field of Classification Search ..... 381/92, 381/94.4, 101, 103
See application file for complete search history.

(56) References Cited

U.S. PATENT DOCUMENTS

| | | | | |
|---|---|---|---|---|
| 6,549,627 | B1 * | 4/2003 | Rasmusson et al. | 381/71.11 |
| 2003/0147538 | A1 * | 8/2003 | Elko | 381/92 |
| 2007/0053455 | A1 * | 3/2007 | Sugiyama | 375/260 |

* cited by examiner

*Primary Examiner* — Wai Sing Louie
(74) *Attorney, Agent, or Firm* — Jackson Walker L.L.P.; Christopher J. Rourk

(57) ABSTRACT

An apparatus for providing real-time calibration for two or more microphones. A calibrator for receiving a left microphone signal and a right microphone signal and generating phase difference data. A phase and amplitude correction system for receiving one of the left microphone signal or the right microphone signal the phase difference data and generating calibration data for a beamformer. The beamformer receiving the calibration data, the left microphone signal and the right microphone signal and generating a monaural beamformed signal.

20 Claims, 7 Drawing Sheets

MICROPHONE ARRAY CALIBRATION METHOD AND APPARATUS

FIELD OF THE INVENTION

The invention relates to microphone array calibration using a pair of small separation microphones, and more particularly to a micro-array beamforming method and apparatus that allow un-match microphone pairs to be used that eliminates the need for costly offline calibration process by using real time calibration based on signals received during normal use.

BACKGROUND OF THE INVENTION

In the past, beamforming with small separation microphones has relied on two possible solutions: 1) microphone matching, or 2) offline microphone calibration. Matching microphone pairs is done during the manufacturing of the microphones, and is a time consuming process that also reduces the yield of the microphone pairs, thus increasing the price of the microphones. Offline microphone calibration uses specific calibration signals and needs to be executed, in a quiet environment, during the manufacturing of the end product. This adds extra cost to the manufacturing process of the end product. Both of the solutions used today thus incur an added cost.

SUMMARY OF THE INVENTION

The current invention provides a method and apparatus for real time calibration for microphone arrays that eliminates the need for microphone matching or offline microphone calibration.

In accordance with an exemplary embodiment of the present invention, an apparatus for providing real-time calibration for two or more microphones is disclosed. A calibrator receives a left microphone signal and a right microphone signal and generates phase difference data. A phase and amplitude correction system receives one of the left microphone signal or the right microphone signal the phase difference data and generates calibration data for a beamformer. The beamformer receives the calibration data, the left microphone signal and the right microphone signal and generates a monaural beamformed signal.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
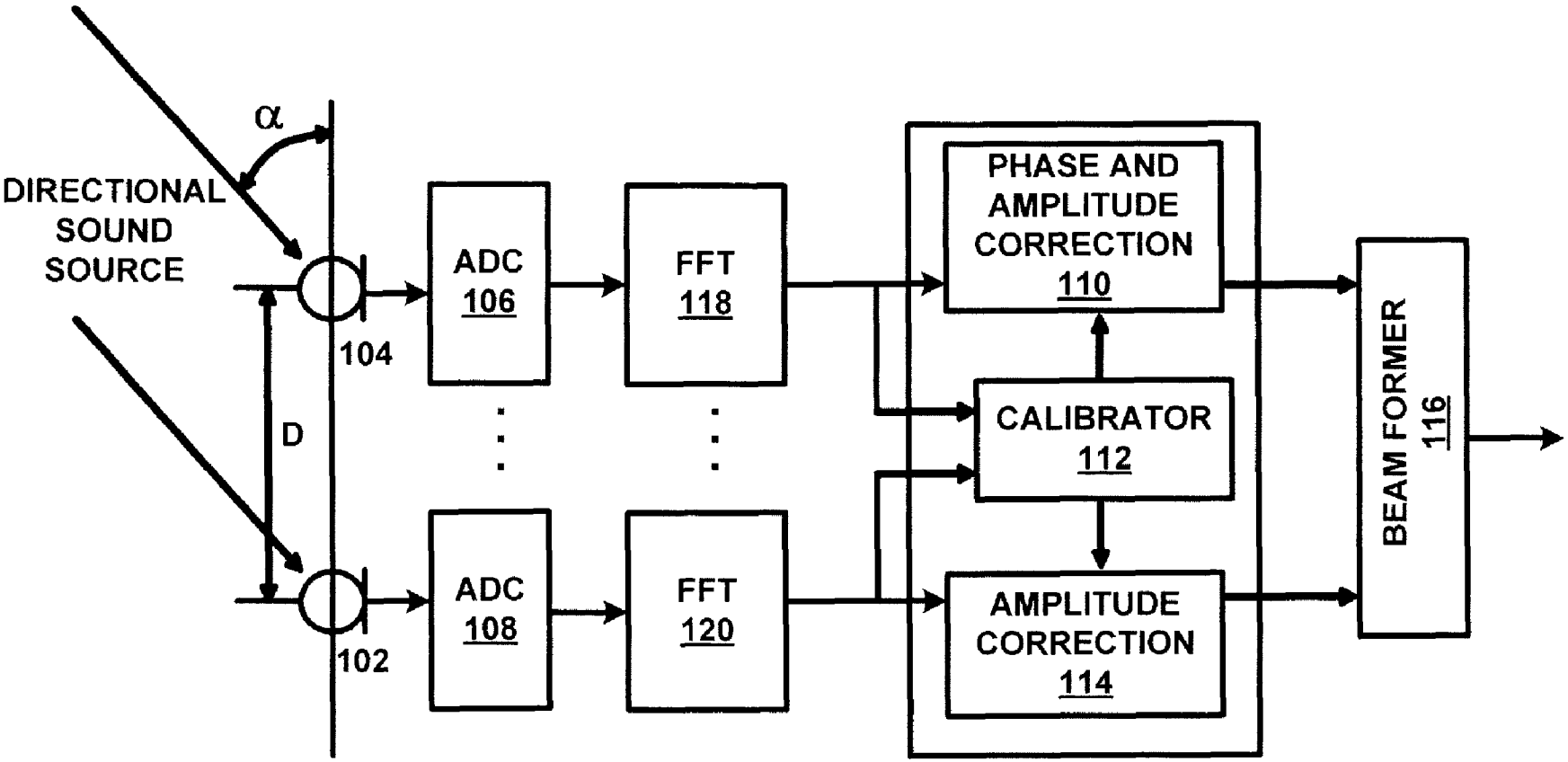
FIG. 1 is a diagram of a system for equalizing the phase and amplitude of a microphone array in accordance with an exemplary embodiment of the present invention.

In the description that follows, like parts are marked throughout the specification and drawings with the same reference numerals, respectively. The drawing figures might not be to scale, and certain components can be shown in generalized or schematic form and identified by commercial designations in the interest of clarity and conciseness.

FIG. 1 is a diagram of a system 100 for equalizing the phase and amplitude of a microphone array in accordance with an exemplary embodiment of the present invention. System 100 provides real-time compensation for mismatch in the phase and amplitude characteristics of the microphones, allowing accurate beamforming, and can be used as a preprocessor to a suitable frequency domain beam-forming process to improve the accuracy and the performance of the beam-former, or for other suitable purposes.

System 100 can be implemented in hardware or a suitable combination of hardware and software, and can include one or more software systems operating on a digital signal processing platform. As used herein, "hardware" can include a combination of discrete components, an integrated circuit, an application-specific integrated circuit, a field programmable gate array, a digital signal processor, or other suitable hardware. As used herein, "software" can include one or more objects, agents, threads, lines of code, subroutines, separate software applications, two or more lines of code or other suitable software structures operating in two or more software applications or on two or more processors, or other suitable software structures. In one exemplary embodiment, software can include one or more lines of code or other suitable software structures operating in a general purpose software application, such as an operating system, and one or more lines of code or other suitable software structures operating in a specific purpose software application.

Left microphone 102 and right microphone 104 receive time domain signals that are transformed into frequency domain signals, such as by using analog to digital converters 106 and 108 and fast Fourier transformers 118 and 120, respectively, or other suitable components. Additional microphone inputs can also or alternatively be used, but left microphone 102 and right microphone 104 are only shown in the interest of clarity. The conversion from the time domain to the frequency domain divides the signal into frequency bands, and can be accomplished using a short time discrete Fourier transform, filter banks, polyphase filtering, or other suitable processes.

Calibrator 112, phase and amplitude correction 110 and amplitude correction 114 are used to calibrate the signals received from left microphone 102 and right microphone in conjunction with beamformer 116, so as to provide real-time compensation for the mismatch in the phase and amplitude characteristics of the microphones, allowing accurate beamforming.

At a given time for a given frequency bin, n, the signals from left microphone 102 and right microphone 104 can be defined in a two microphone array by the following equations:

$$X_{L,n} = |X_{L,n}|e^{j(\psi_n - \frac{\phi_n}{2} + \delta_{L,n})}$$

$$X_{R,n} = |X_{R,n}|e^{j(\psi_n + \frac{\phi_n}{2} + \delta_{R,n})}$$

where $\phi_n$ is the phase difference between the signals from left microphone 102 and right microphone 104 for frequency bin n, assuming ideal microphone elements. $\psi_n$ is the phase of the signal at the center location between the microphones. $\delta_{L,n}$ and $\delta_{R,n}$ are phase shift values of left microphone 102 and right microphone 104 at frequency bin n due to deviation from ideal elements. The phase difference $\phi_n$ includes data determined by the direction of arrival of the signal.

Based on the relationship:

$$X^*_{L,n}X_{R,n} = |X_{L,n}||X_{R,n}|e^{j(\phi_n + \delta_{R,n} - \delta_{L,n})} = a_n + jb_n$$

the phase difference can be calculated as:

$$\theta_n = \tan^{-1}\left(\frac{b_n}{a_n}\right)$$

If left microphone 102 matches right microphone 104, such that ($\delta_{R,n} - \delta_{L,n} = 0$), then $\theta_n = \phi_n$ and the direction of arrival for the signal in frequency bin n can then be calculated as:

$$\alpha_n = \cos^{-1}\left(\frac{\theta_n * v}{d * f_n * 2\pi}\right)$$

where v is the speed of sound in air, d is the distance between the microphones and $f_n$ is the center frequency of the n-th frequency bin.

In general, for unmatched microphones, the phase shift values are different, such that ($\delta_{R,n} - \delta_{L,n} \neq 0$). This difference in phase shift values causes an error in the direction of arrival estimate, in accordance with the following equation:

$$\alpha_n = \cos^{-1}\left(\frac{\phi_n * v}{d * f_n * 2\pi} + \frac{(\delta_{R,n} - \delta_{L,n}) * v}{d * f_n * 2\pi}\right)$$

These differences in phase shift values can cause large errors in the direction of arrival estimate, especially for closely spaced microphones (d is small). These errors can cause degradation of any beamforming algorithm and even render them useless.

In the case where there is a one directional sound source and diffused background noise, we can calculate the average of the calculated phase difference as:

$$\bar{\theta} = E(\theta_n) = E(\delta_{R,n} - \delta_{L,n}) + E(\phi_n) = \theta_{n,offset} + \frac{d * f_n * 2\pi * E(\cos(\alpha_n))}{v}$$

where the E( ) function can be a suitable average function, such as a moving-window average or low pass IIR, $$\theta_{n,offset} = E(\delta_{R,n} - \delta_{L,n});$$

and $$E(\phi_n) = \frac{d * f_n * 2\pi * E(\cos(\alpha_n))}{v}$$

If the sound source is in front of the microphone array, that is $\alpha_n = \pi/2$ then $\bar{\theta}$ is the actual phase difference in the phase response for the microphone pair $\bar{\theta} = \theta_{n,offset} = \delta_{R,n} - \delta_{L,n}$. If the sound source is coming from a side direction, $\alpha_n$, then the estimate is the actual phase difference plus a constant $E(\phi_n)$. In general for single directional sound source the algorithm estimates:

$$\bar{\theta}_n = \theta_{n,offset} + \frac{d * f_n * 2\pi * E(\cos(\alpha_n))}{v}$$

This represents the actual phase difference in the microphone response plus an offset that is directly related to the direction of arrival of the directional sound source.

The offset $\theta_{n,offset}$ or $\bar{\theta}_n$ can be used with phase adjustment procedure in the beam-forming algorithm. If the beam-forming algorithm calculates $\theta_n$ explicitly then $\theta_{n,offset}$ or $\bar{\theta}_n$ can be subtracted directly from $\theta_n$. Another option is to construct a new output signals from the array as follows $$Y_{L,n} = X_{L,n}e^{j(\theta_{n,offset})} = |X_{L,n}|e^{j(\psi_n - \frac{\phi_n}{2} + \delta_{L,n} + \theta_{n,offset})}$$

$$Y_{R,n} = X_{R,n} = |X_{R,n}|e^{j(\psi_n + \frac{\phi_n}{2} + \delta_{R,n})}$$

If the beam-forming algorithm requires an identical amplitude response from the microphones, then the gain can be equalized as follows, $$Y_{L,n} = f(|X_{L,n}|, |X_{R,n}|)e^{j(\psi_n - \frac{\phi_n}{2} + \delta_{L,n} + \theta_{n,offset})}$$

$$Y_{R,n} = f(|X_{L,n}|, |X_{R,n}|)e^{j(\psi_n + \frac{\phi_n}{2} + \delta_{R,n})}$$

Where f( ) is a suitable one to one function. This process can be used with closely spaced microphones because the amplitude of the received signal does not convey any directional information, when the microphones are closely spaced. It is also possible to tilt the beam of any beam-forming algorithm in the direction of the sound source, $\alpha_n$, that was used for the calibration. Tilting can be done by using $\bar{\theta}_n$ directly, such as in accordance with the following:

$$Y_{L,n} = X_{L,n}e^{j(\bar{\theta})} = f(|X_{L,n}|, |X_{R,n}|)e^{j(\psi_n - \frac{\phi_n}{2} + \delta_{L,n} + \theta_{n,offset} + E(\psi_n))}$$

$$Y_{R,n} = f(|X_{L,n}|, |X_{R,n}|)e^{j(\psi_n + \frac{\phi_n}{2} + \delta_{R,n})}$$

It should be stated that the phase correction could be done on the right channel by flipping the sign on $\theta_{n,offset}$ or $\bar{\theta}_n$. As stated above, the calculation of the average assumes that there is only one single directional sound source present during the averaging. Thus, to calculate the average, a decision mechanism can be used to determine whether there is only a single directional sound source present, since the calculation cannot be done when there are more than one directional sound source active at the same time. Furthermore, in many cases it is desirable to be able to estimate the direction of that sound source since that allows $\theta_{n,offset}$ to be isolated.

It has been experimentally verified that for most un-matched microphone pairs of the same type, that the offset in phase response in the frequency range 2-4 kHz can be considered negligible. Therefore, even for un-calibrated pairs, the direction of arrival estimate in this frequency range can be considered accurate enough for most beam-forming applications, because the phase difference due to microphone phase mismatch becomes less significant when compared to the phase difference due to physical incoming angle in this frequency range. This process can be used to provide a mechanism to ensure that training is preformed only with the presence of center speech. If it is determined that speech is coming from the center by observing whether the direction of arrival angles of the incoming sound within 2-4 kHz frequency range is within the desired beam width, such as by determining whether the total count of frequencies that have sound from within the beam width is above a certain threshold, then the signal can be processed for speech that is coming from the center. If no speech is coming from the center, training is paused until center speech is detected again. Training ends when it is determined that phase errors in the low frequency bands have stabilized. In one exemplary embodiment, it can be determined whether speech is coming from the center using the following algorithm or other suitable algorithms:

```
for ( all frequencies )
{
    if ( speech is detected and energy above energy threshold)
    {
        if (frequency between 2 kHz to 4 kHz)
        {
            increment InBeamVote
        }
        if ( Phase Error Training is on)
        {
            Phase Correction Per Frequency = take average
    with the new sound angle
        }
        Correct phase on Left channel according to Phase
    Correction Per Frequency
    }
}
if ( Phase Error Training is on)
{
    if ( variations on Phase Correction Per Frequency on
    monitor frequency (example:312 Hz) becomes small (i.e.
    converged))
    {
        Phase training is done : Turn off Phase Error Training
    }
}
if ( InBeamVote > threshold and phase training is not done)
{
    Sound is from center: Turn on Phase Error Training
}
```

Using these principles, system 100 includes phase and amplitude correction 110, calibrator 112 and amplitude correction 114, which can process the frequency domain right and left microphone signals to generate an output to beamformer 116. The various embodiments described above are described in greater detail below.

Figure 2:
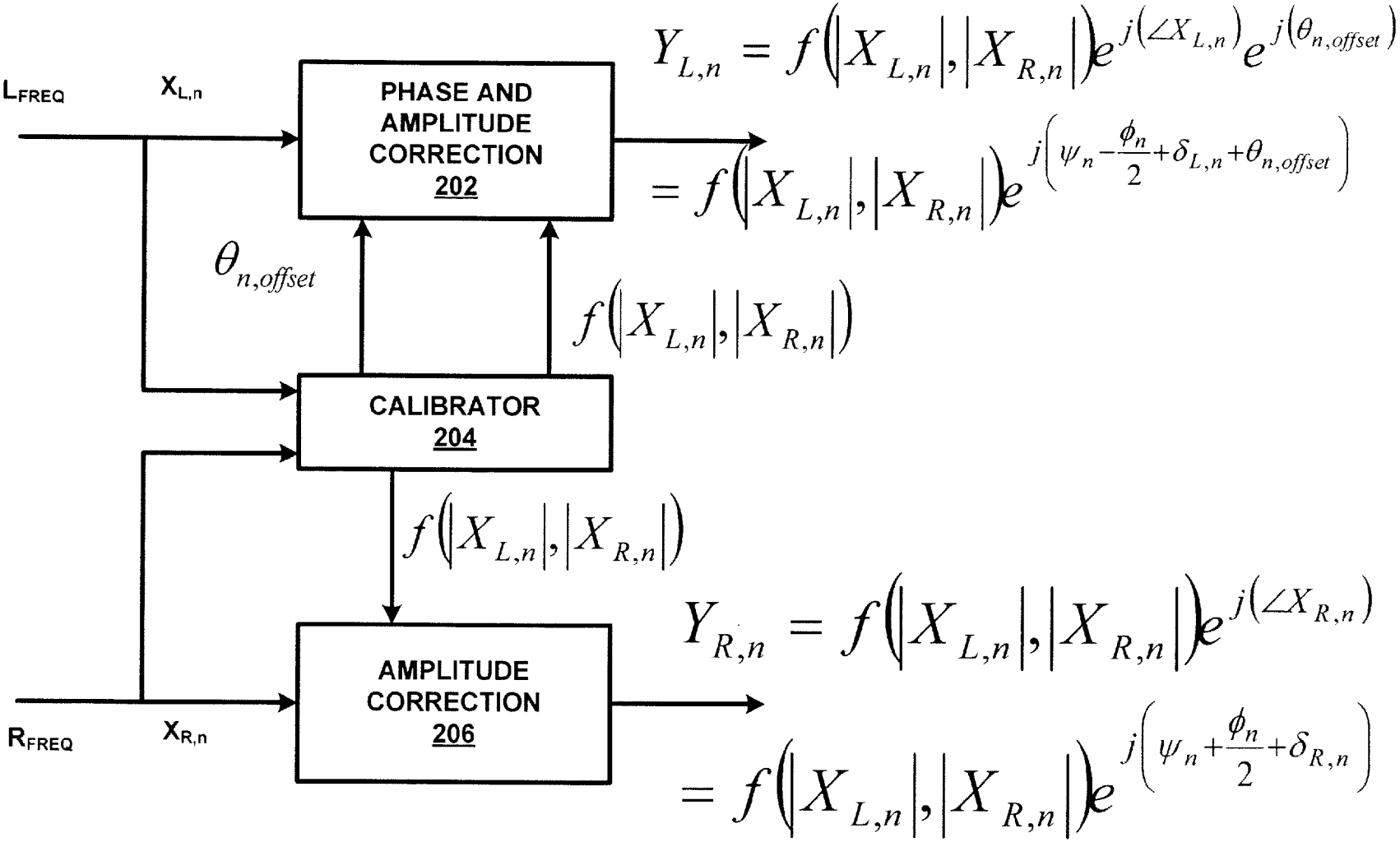
FIG. 2 is a diagram of a system for processing signals from a microphone array to provide phase adjustment and gain equalization in accordance with an exemplary embodiment of the present invention.

FIG. 2 is a diagram of a system 200 for processing signals from a microphone array to provide phase adjustment and gain equalization in accordance with an exemplary embodiment of the present invention.

System 200 includes phase and amplitude correction 202, calibrator 204 and amplitude correction 206. Calibrator 204 receives the frequency domain data from a left microphone and a right microphone, and generates a signal output to amplitude correction 206 in accordance with:

$$f(|X_{L,n}|, |X_{R,n}|)$$

as described above. Calibrator 204 also generates a signal output to phase and amplitude correction 202 in accordance with:

$$\theta_{n,offset} \text{ and}$$

$$f(|X_{L,n}|, |X_{R,n}|)$$

as described above.

Based on the left microphone frequency domain data and the signals received from calibrator 204, phase and amplitude correction 202 generates a left microphone output to the beamformer in accordance with:

$$Y_{L,n} = f(|X_{L,n}|, |X_{R,n}|)e^{j(\angle X_{L,n})}e^{j(\theta_{n,offset})} = f(|X_{L,n}|, |X_{R,n}|)e^{j(\psi_n - \frac{\phi_n}{2} + \delta_{L,n} + \theta_{n,offset})}$$

as described above. Likewise, based on the frequency domain signals received from the right microphone and signals received from calibrator 204, amplitude correction 206 generates a right microphone output to the beamformer in accordance with:

$$Y_{R,n} = f(|X_{L,n}|, |X_{R,n}|)e^{j(\angle X_{R,n})} = f(|X_{L,n}|, |X_{R,n}|)e^{j(\psi_n + \frac{\phi_n}{2} + \delta_{R,n})}$$

as described above. In this manner, the phase and amplitude of a microphone array are equalized for use by the beamformer.

Figure 3:
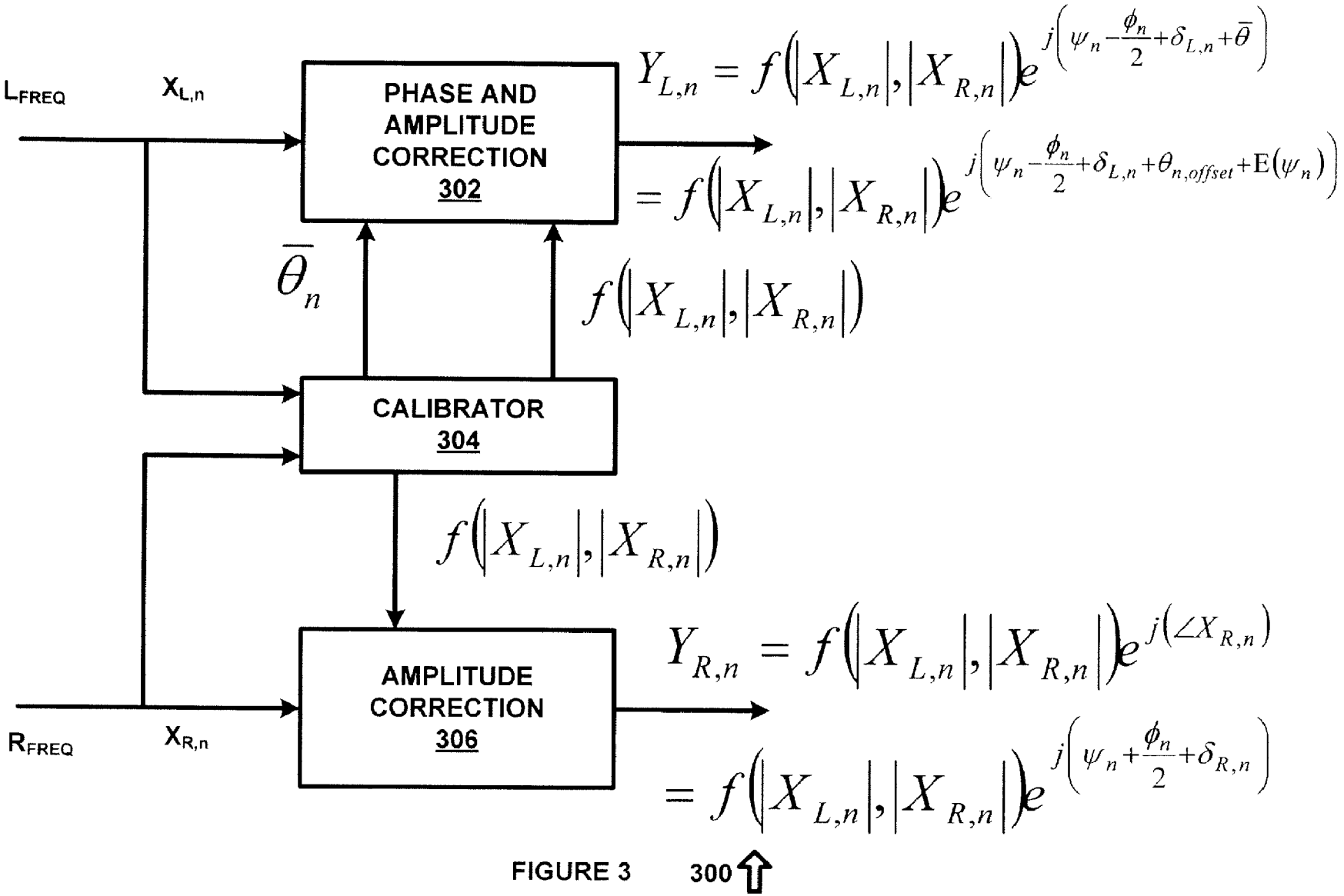
FIG. 3 is a diagram of a system for processing signals from a microphone array to provide phase adjustment, gain equalization and tilt in accordance with an exemplary embodiment of the present invention.

FIG. 3 is a diagram of a system 300 for processing signals from a microphone array to provide phase adjustment, gain equalization and tilt in accordance with an exemplary embodiment of the present invention.

System 300 includes phase and amplitude correction 302, calibrator 304 and amplitude correction 306. Calibrator 304 receives the frequency domain data from a left microphone and a right microphone, and generates a signal output to amplitude correction 306 in accordance with:

$$f(|X_{L,n}|, |X_{R,n}|)$$

as described above. Calibrator 304 also generates a signal output to phase and amplitude correction 302 in accordance with:

$$\overline{\theta}_n \text{ and}$$

$$f(|X_{L,n}|, |X_{R,n}|)$$

as described above.

Based on the left microphone frequency domain data and the signals received from calibrator 304, phase and amplitude correction 302 generates a left microphone output to the beamformer in accordance with:

$$Y_{L,n} = f(|X_{L,n}|, |X_{R,n}|)e^{j(\psi_n - \frac{\phi_n}{2} + \delta_{L,n} + \overline{\theta})} = f(|X_{L,n}|, |X_{R,n}|)e^{j(\psi_n - \frac{\phi_n}{2} + \delta_{L,n} + \theta_{n,offset} + E(\psi_n))}$$

as described above. Likewise, based on the right microphone frequency domain signals and the signals received from calibrator 304, amplitude correction 306 generates a right microphone output to the beamformer in accordance with:

$$Y_{R,n} = f(|X_{L,n}|, |X_{R,n}|)e^{j(\angle X_{R,n})} = f(|X_{L,n}|, |X_{R,n}|)e^{j(\psi_n + \frac{\phi_n}{2} + \delta_{R,n})}$$

as described above. In this manner, the phase and amplitude of a microphone array are equalized and tilt correction is provided for use by the beamformer.

Figure 4:
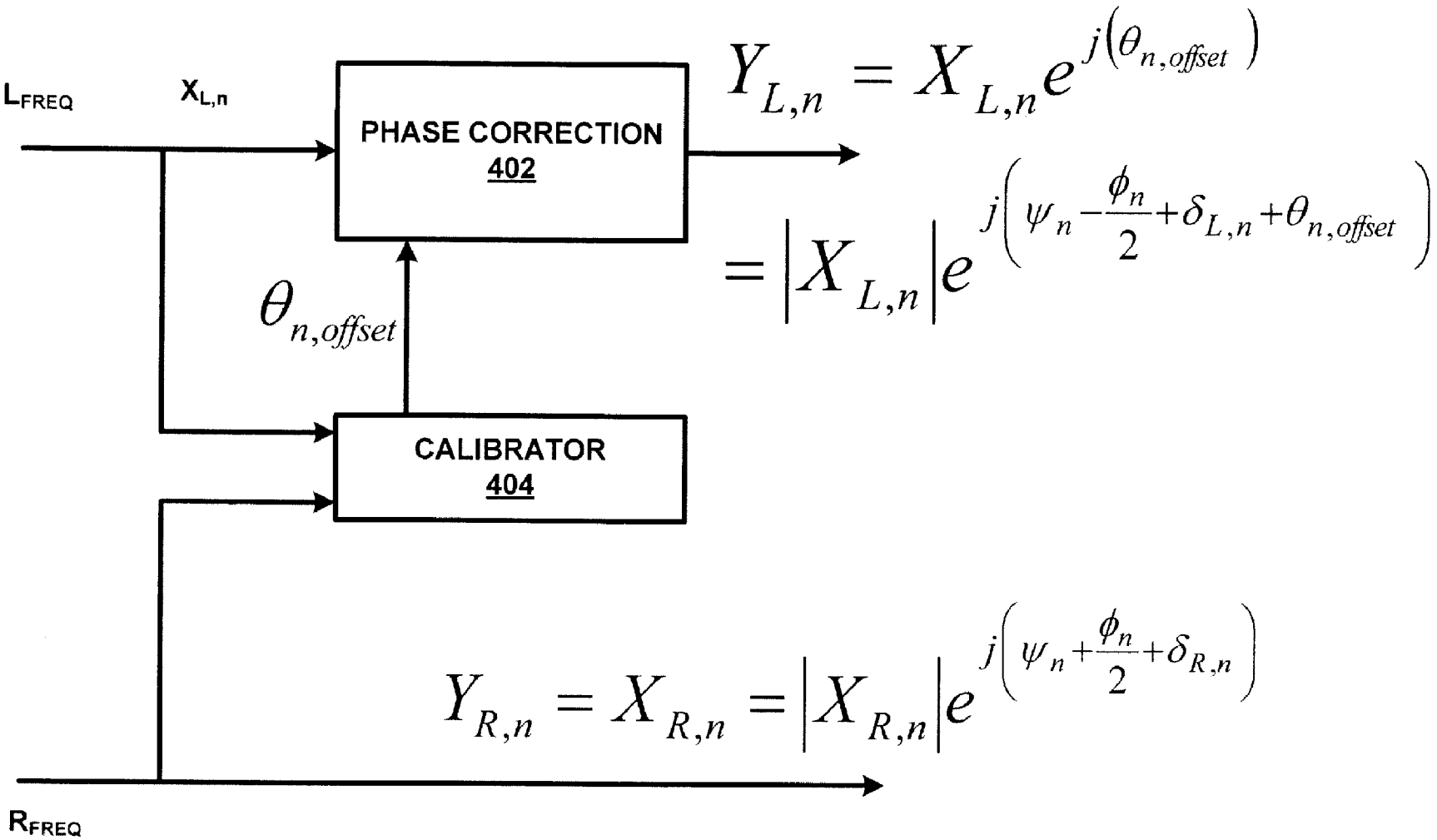
FIG. 4 is a diagram of a system for processing signals from a microphone array to provide phase adjustment in accordance with an exemplary embodiment of the present invention.

FIG. 4 is a diagram of a system 400 for processing signals from a microphone array to provide phase adjustment in accordance with an exemplary embodiment of the present invention.

System 400 includes phase correction 402 and calibrator 404. Calibrator 404 receives the frequency domain data from a left microphone and a right microphone, and generates a signal output to phase correction 402 in accordance with:

$$\theta_{n,offset}$$

as described above.

Based on the left microphone frequency domain data and the signals received from calibrator 404, phase correction 402 generates a left microphone output to the beamformer in accordance with:

$$Y_{L,n} = X_{L,n}e^{j(\theta_{n,offset})} = |X_{L,n}|e^{j(\psi_n - \frac{\phi_n}{2} + \delta_{L,n} + \theta_{n,offset})}$$

as described above. Likewise, the frequency domain signals received from the right microphone are provided to the beamformer in accordance with:

$$Y_{R,n} = X_{R,n} = |X_{R,n}|e^{j(\psi_n + \frac{\phi_n}{2} + \delta_{R,n})}$$

as described above. In this manner, the phase of a microphone array is corrected for use by the beamformer.

Figure 5:
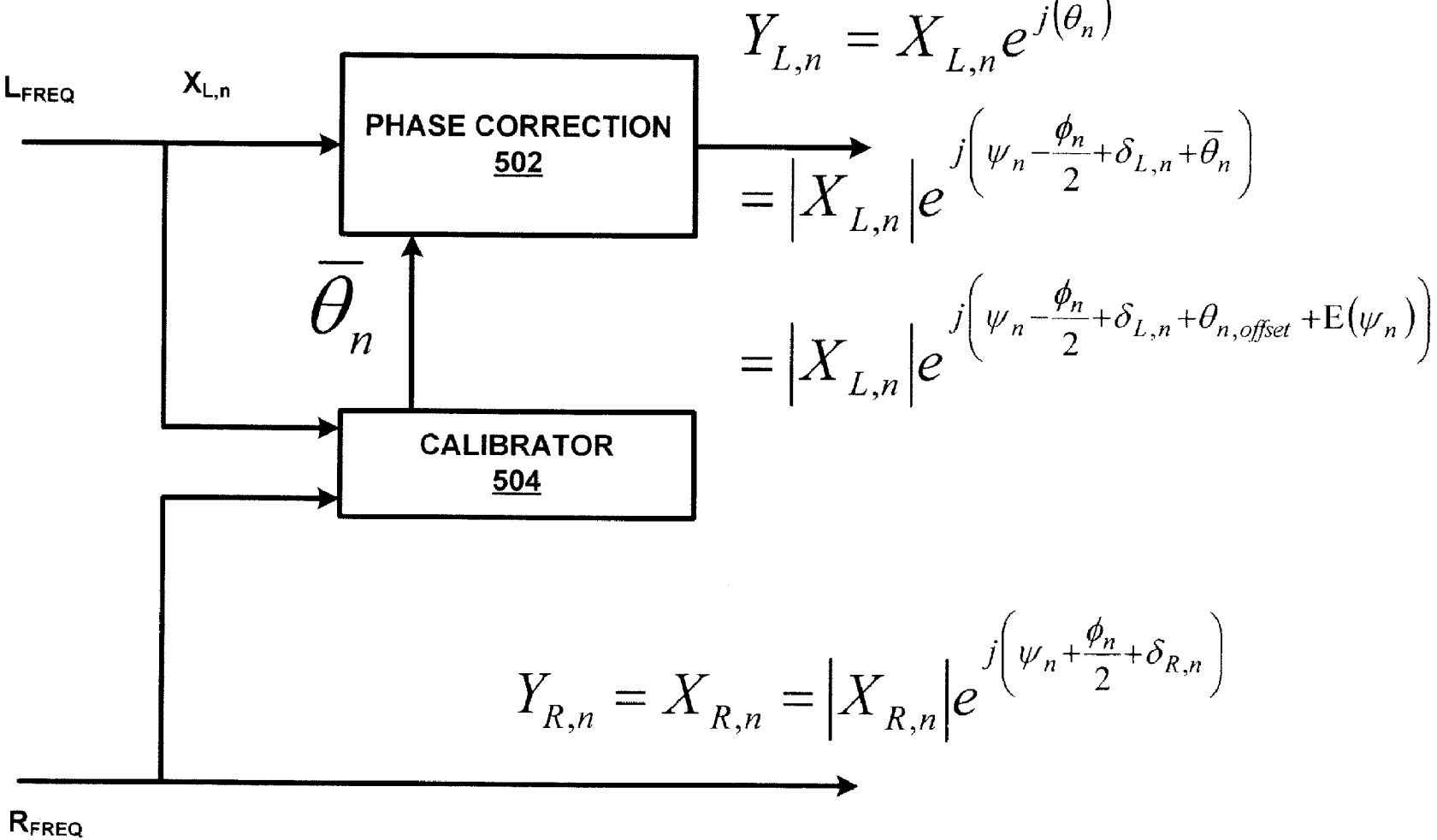
FIG. 5 is a diagram of a system for processing signals from a microphone array to provide phase adjustment and tilt in accordance with an exemplary embodiment of the present invention.

FIG. 5 is a diagram of a system 500 for processing signals from a microphone array to provide phase adjustment and tilt in accordance with an exemplary embodiment of the present invention.

System 500 includes phase correction 502 and calibrator 504. Calibrator 504 receives the frequency domain data from a left microphone and a right microphone, and generates a signal output to phase correction 502 in accordance with:

$$\overline{\theta}_n$$

as described above.

Based on the left microphone frequency domain data and the signals received from calibrator 504, phase correction 502 generates a left microphone output to the beamformer in accordance with:

$$Y_{L,n} = X_{L,n}e^{j(\overline{\theta}_n)} = |X_{L,n}|e^{j(\psi_n - \frac{\phi_n}{2} + \delta_{L,n} + \overline{\theta}_n)} = |X_{L,n}|e^{j(\psi_n - \frac{\phi_n}{2} + \delta_{L,n} + \theta_{n,offset} + E(\psi_n))}$$

as described above. Likewise, the frequency domain right microphone signals are provided to the beamformer in accordance with:

$$Y_{R,n} = X_{R,n} = |X_{R,n}|e^{j(\psi_n + \frac{\phi_n}{2} + \delta_{R,n})}$$

as described above. In this manner, the phase and tilt of a microphone array is corrected for use by the beamformer.

Figure 6:
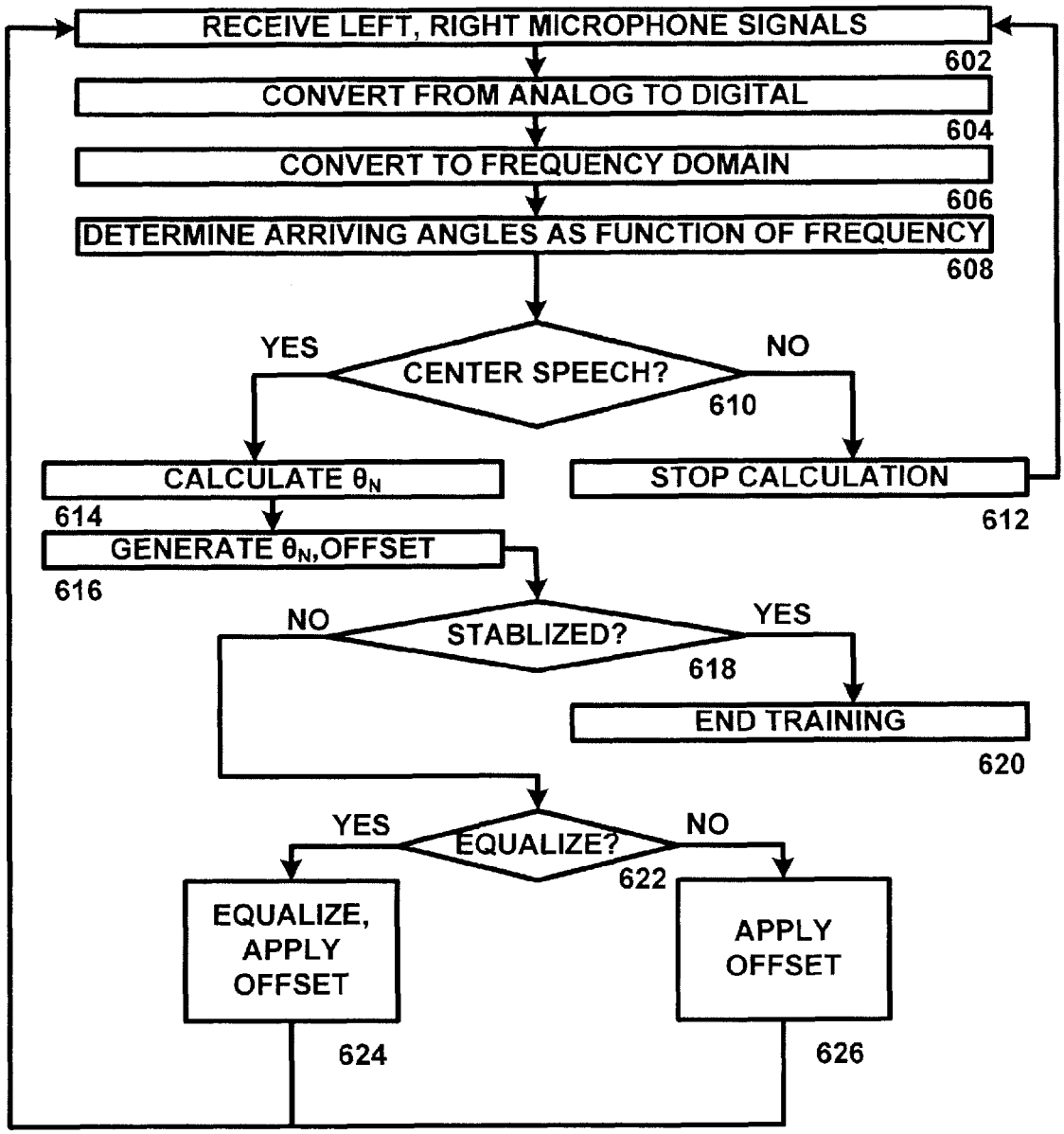
FIG. 6 is a diagram of a method for determining a processing state for equalizing the phase and amplitude of a microphone array in accordance with an exemplary embodiment of the present invention.

FIG. 6 is a diagram of a method 600 for determining a processing state for equalizing the phase and amplitude of a microphone array in accordance with an exemplary embodiment of the present invention.

Method 600 begins at 602, where left and right analog microphone signals are received. The method then proceeds to 604, where the analog signals are converted to digital signals, such as by sampling the analog signals at a predetermined sampling rate. The method then proceeds to 606, where the digital signals are converted from a time domain to a frequency domain, such as by using a fast Fourier transform or in other suitable manners. The method then proceeds to 608.

At 608, the arriving angles as a function of frequency are determined. In one exemplary embodiment, the arriving angles for predetermined frequency bands can be determined, such as for the frequency range of 2 to 4 kHz in situations where the offset in phase response as a function of microphone characteristics is negligible, or other suitable processes can be used. The method then proceeds to 610.

At 610, it is determined whether center speech is being received, such as speech that is coming from a location within a desired beam width. If it is determined that center speech is not being received, the method proceeds to 612 where calculation of offset and other factors is temporarily halted, and the method returns to 602. Otherwise, the method proceeds to 614.

At 614, a phase difference is determined, such as by using the process described above or in other suitable manners. The method then proceeds to 616 where a phase offset is determined, such as by using the process described above or in other suitable manners. The method then proceeds to 618.

At 618, it is determined whether phase errors in the low frequency bands have stabilized. If the phase errors have stabilized, the method proceeds to 620 and training of the beamforming parameters is terminated. Otherwise, the method proceeds to 622, where it is determined whether gain equalization is required, such as by the beamformer. If it is determined that gain equalization is required, the method proceeds to 624, where correction for phase offset and gain equalization are performed, such as by using the process described above or in other suitable manners. The method then returns to 602. Otherwise, if it is determined at 622 that gain equalization is not required, the method proceeds to 626, where correction for phase offset is performed, such as by using the process described above or in other suitable manners. The method then returns to 602.

Figure 7:
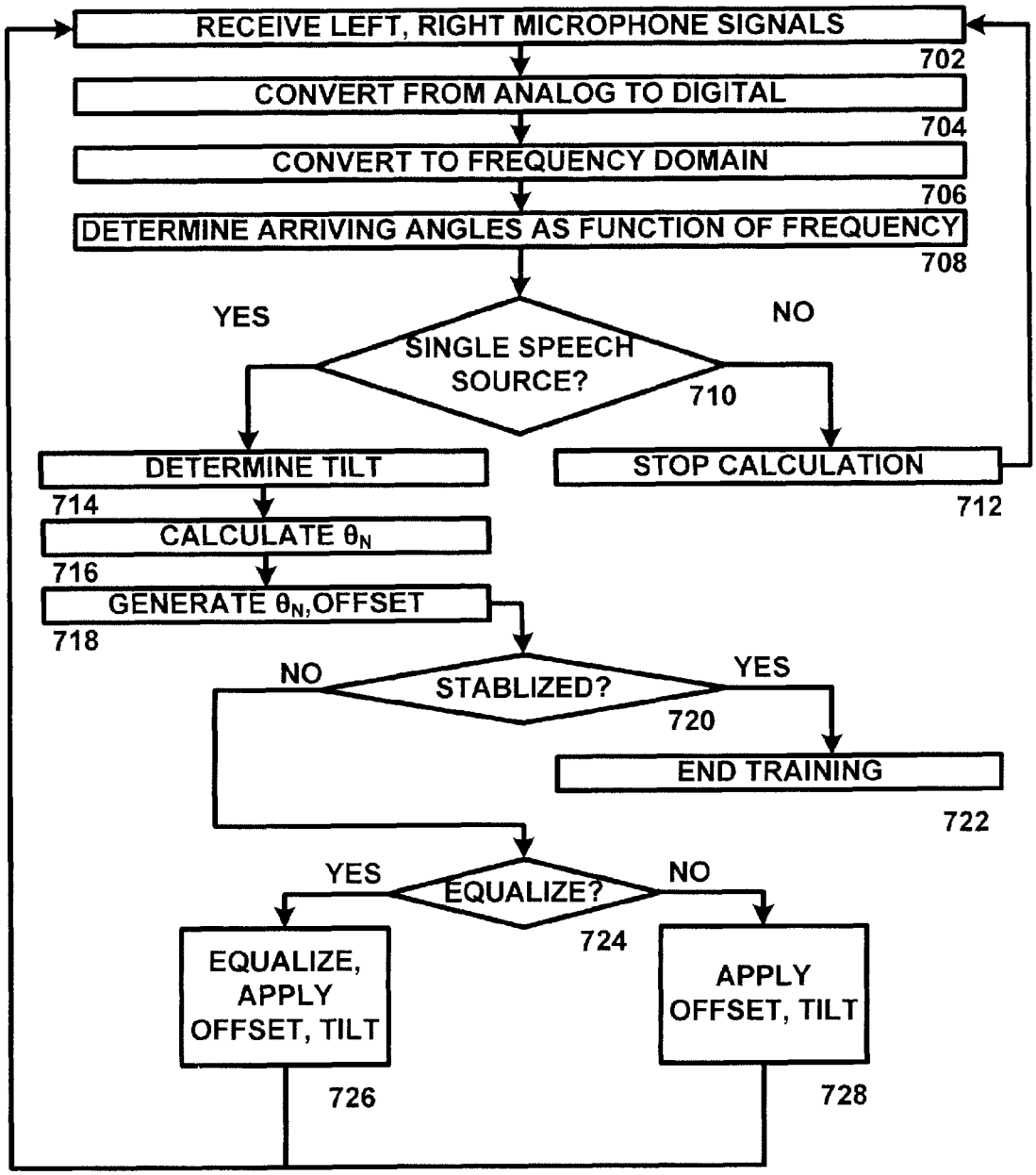
FIG. 7 is a diagram of a method for determining a processing state for determining a tilt angle and equalizing the phase and amplitude of a microphone array in accordance with an exemplary embodiment of the present invention.

FIG. 7 is a diagram of a method 700 for determining a processing state for determining a tilt angle and equalizing the phase and amplitude of a microphone array in accordance with an exemplary embodiment of the present invention.

Method 700 begins at 702, where left and right analog microphone signals are received. The method then proceeds to 704, where the analog signals are converted to digital signals, such as by sampling the analog signals at a predetermined sampling rate. The method then proceeds to 706, where the digital signals are converted from a time domain to a frequency domain, such as by using a fast Fourier transform or in other suitable manners. The method then proceeds to 708.

At 708, the arriving angles as a function of frequency are determined. In one exemplary embodiment, the arriving angles for predetermined frequency bands can be determined, such as for the frequency range of 2 to 4 kHz in situations where the offset in phase response as a function of microphone characteristics is negligible, or other suitable processes can be used. The method then proceeds to 710.

At 710, it is determined whether a signal from a single source is being received, such as speech that is coming from a location within a desired beam width. If it is determined that a speech signal from a single source is not being received, the method proceeds to 712 where calculation of offset and other factors is temporarily halted, and the method returns to 702. Otherwise, the method proceeds to 714.

At 714, a tilt angle is determined, such as by using the process described above or in other suitable manners. The method then proceeds to 716.

At 716, a phase difference is determined, such as by using the process described above or in other suitable manners. The method then proceeds to 718 where a phase offset is determined, such as by using the process described above or in other suitable manners. The method then proceeds to 720.

At 720, it is determined whether phase errors in the low frequency bands have stabilized. If the phase errors have stabilized, the method proceeds to 722 and training of the beamforming parameters is terminated. Otherwise, the method proceeds to 724, where it is determined whether gain equalization is required, such as by the beamformer. If it is determined that gain equalization is required, the method proceeds to 726, where correction for phase offset, tilt and gain equalization are performed, such as by using the process described above or in other suitable manners. The method then returns to 702. Otherwise, if it is determined at 724 that gain equalization is not required, the method proceeds to 728, where correction for phase offset and tilt is performed, such as by using the process described above or in other suitable manners. The method then returns to 702.

Although exemplary embodiments of an apparatus of the present invention have been described in detail herein, those skilled in the art will also recognize that various substitutions and modifications can be made to the apparatus without departing from the scope and spirit of the appended claims.

What is claimed is:

1. An apparatus for providing real-time calibration for two or more microphones comprising:

a calibrator for receiving a first microphone signal and a second microphone signal and generating phase difference data;

a phase correction system for receiving the phase difference data for one of the first microphone signal or the second microphone signal and generating calibration data for a beamformer; and the beamformer receiving the calibration data, the first microphone signal and the second microphone signal and generating a signal.

2. The apparatus of claim 1 further comprising an amplitude correction system for receiving the other of the first microphone signal or the second microphone signal and generating second calibration data for a beamformer, wherein the beamformer is for receiving the first calibration data, the second calibration data, the first microphone signal and the second microphone signal and generating a signal.

3. The apparatus of claim 1 further comprising an amplitude correction system for receiving the other of the first microphone signal or the second microphone signal and gain equalization data from the calibrator and generating second calibration data for a beamformer, wherein the beamformer is for receiving the first calibration data, the second calibration data, the first microphone signal and the second microphone signal and generating a signal.

4. The apparatus of claim 1 wherein the calibrator is for receiving the first microphone signal and the second microphone signal and generating the phase difference data and gain equalization data.

5. The apparatus of claim 1 further comprising a system for receiving the other of the first microphone signal or the second microphone signal and generating second calibration data for the beamformer, and the beamformer is for generating the signal with compensation for phase offset from the first microphone signal and the second microphone signal.

6. The apparatus of claim 1 further comprising an amplitude correction system for receiving the other of the first microphone signal or the second microphone signal and generating second calibration data for the beamformer, and the beamformer is for generating the signal with compensation for phase offset and gain equalization from the first microphone signal and the second microphone signal.

7. The apparatus of claim 1 further comprising an amplitude correction system for receiving the other of the first microphone signal or the second microphone signal and generating second calibration data for the beamformer, and the beamformer is for generating the signal with compensation for phase offset, gain equalization, and to tilt the signal from the first microphone signal and the second microphone signal.

8. The apparatus of claim 1 further comprising a system for receiving the other of the first microphone signal or the second microphone signal and generating second calibration data for the beamformer, and the beamformer is for generating the signal with compensation for phase offset and to tilt the signal from the first microphone signal and the second microphone signal.

9. The apparatus of claim comprising:

a phase and amplitude correction system for receiving the phase difference data for one or more of the plurality of microphones and generating calibration data for a beamformer in accordance with $$f(|X_{L,n}|, |X_{R,n}|)e^{j\left(\psi_n - \frac{\phi_n}{2} + \delta_{L,n} + \theta_{n,offset}\right)}.$$

10. An apparatus for providing real-time calibration for two or more microphones comprising:

a calibrator for receiving a first microphone signal and a second microphone signal and generating phase difference data;

means for generating calibration data for a beamformer; and the beamformer receiving the calibration data, the first microphone signal and the second microphone signal and generating a signal.

11. The apparatus of claim 10 further comprising means for performing gain equalization of the first microphone signal and the second microphone signal.

12. The apparatus of claim 10 further comprising means for performing tilt compensation of the first microphone signal and the second microphone signal.

13. The apparatus of claim 10 further comprising means for performing gain equalization and tilt compensation of the first microphone signal and the second microphone signal.

14. The apparatus of claim 10 further comprising means for determining whether a phase error has stabilized and terminating calibration if the phase error has stabilized.

15. An apparatus for providing real-time calibration for two or more microphones comprising:

a calibrator for receiving a left microphone signal and a right microphone signal and generating phase difference data;

a phase and amplitude correction system for receiving the phase difference data and the left microphone signal and generating a beamformer left microphone signal in accordance with the equation $$Y_{L,n} = f(|X_{L,n}|, |X_{R,n}|)e^{j\left(\psi_n - \frac{\phi_n}{2} + \delta_{L,n} + \theta_{n,offset}\right)};$$

and the beamformer receiving the beamformer left microphone signal and the right microphone signal and generating an output.

16. The apparatus of claim 15 further comprising an amplitude correction system for receiving the right microphone signal and generating a beamformer right microphone signal in accordance with the equation $$Y_{R,n} = f(|X_{L,n}|, |X_{R,n}|)e^{j\left(\psi_n + \frac{\phi_n}{2} + \delta_{R,n}\right)},$$

wherein the beamformer is for receiving the beamformer right microphone signal and generating the output.

17. The apparatus of claim 15 further comprising an amplitude correction system for receiving the right microphone signal and gain equalization data from the calibrator and generating calibration data for a beamformer, wherein the beamformer is for receiving the calibration data and generating the output.

18. The apparatus of claim 15 wherein the calibrator is for receiving the left microphone signal and the right microphone signal and generating the phase difference data and gain equalization data.

19. The apparatus of claim 15 further comprising a system for receiving the left microphone signal or the right microphone signal and generating calibration data for the beamformer, and the beamformer is for generating the output with compensation for phase offset from the left microphone signal and the right microphone signal.

20. The apparatus of claim 15 further comprising an amplitude correction system for receiving the left microphone signal or the right microphone signal and generating calibration data for the beamformer, and the beamformer is for generating the output with compensation for phase offset and gain equalization from the left microphone signal and the right microphone signal.

* * * * *

UNITED STATES PATENT AND TRADEMARK OFFICE

CERTIFICATE OF CORRECTION

PATENT NO. : 8,243,952 B2
APPLICATION NO. : 12/341777
DATED : August 14, 2012
INVENTOR(S) : Trausti Thormundsson, Harry K. Lau and Yair Kerner It is certified that error appears in the above-identified patent and that said Letters Patent is hereby corrected as shown below:

Column 10, line 36, add "1" after "claim" and before "comprising"

Signed and Sealed this
Twenty-fifth Day of September, 2012

David J. Kappos

David J. Kappos
*Director of the United States Patent and Trademark Office*